US008505767B2

(12) United States Patent
Giraud et al.

(10) Patent No.: US 8,505,767 B2
(45) Date of Patent: Aug. 13, 2013

(54) LEAK PROOF CONTAINER

(76) Inventors: Jean-Pierre Giraud, Auburn, AL (US); Michel Zbirka, Jouy-sur-Morin (FR)

( * ) Notice: Subject to any disclaimer, the term of this patent is extended or adjusted under 35 U.S.C. 154(b) by 103 days.

(21) Appl. No.: 12/907,266

(22) Filed: Oct. 19, 2010

(65) Prior Publication Data

US 2011/0089178 A1 Apr. 21, 2011

Related U.S. Application Data

(60) Provisional application No. 61/253,254, filed on Oct. 20, 2009.

(51) Int. Cl.
*A47G 19/22* (2006.01)
*B65D 51/16* (2006.01)
*F16K 15/14* (2006.01)

(52) U.S. Cl.
USPC ..... 220/714; 220/203.19; 220/373; 251/331

(58) Field of Classification Search
USPC ..... 220/200, 367.1, 714, 713, 711, 203.2, 220/203.19, 203.02, 203.01; 215/364, 312, 215/311, 307, 200; 222/562, 547; D9/449, D9/447, 435; 251/331, 318, 359, 356
IPC ..... A47G 19/22; B65D 51/16; F16K 1/16, F16K 15/14
See application file for complete search history.

(56) References Cited

U.S. PATENT DOCUMENTS

| | | | | | |
|---|---|---|---|---|---|
| 4,428,498 | A * | 1/1984 | Obey | 220/367.1 |
| 4,433,800 | A * | 2/1984 | Owens | 222/547 |
| 4,828,141 | A * | 5/1989 | Coy | 220/380 |
| 4,836,404 | A * | 6/1989 | Coy | 220/714 |
| 5,542,670 | A * | 8/1996 | Morano | 220/714 |
| 5,702,025 | A * | 12/1997 | Di Gregorio | 220/717 |
| 5,706,973 | A * | 1/1998 | Robbins et al. | 220/714 |
| 5,890,619 | A * | 4/1999 | Belanger | 220/713 |
| 5,890,620 | A * | 4/1999 | Belcastro | 220/714 |
| 5,890,621 | A * | 4/1999 | Bachman et al. | 220/717 |
| 6,422,415 | B1 * | 7/2002 | Manganiello | 220/714 |
| 2001/0035420 | A1 * | 11/2001 | Fusco et al. | 220/714 |
| 2002/0033399 | A1 * | 3/2002 | Manganiello et al. | 220/714 |
| 2003/0209555 | A1 * | 11/2003 | Belcastro | 220/714 |
| 2005/0247719 | A1 * | 11/2005 | Loging | 220/714 |
| 2008/0000920 | A1 * | 1/2008 | Ho | 220/711 |
| 2009/0020544 | A1 | 1/2009 | Yuen | |

FOREIGN PATENT DOCUMENTS

WO WO2004064578 8/2004

OTHER PUBLICATIONS

Patent Cooperation Treaty—International Searching Authority International Search Report and the Written Opinion of the International Searching Authority, International Application No. PCT/EP2010/006394, Filed Oct. 19, 2010.

* cited by examiner

*Primary Examiner* — Mickey Yu
*Assistant Examiner* — Robert J Hicks
(74) *Attorney, Agent, or Firm* — McAndrews, Held & Malloy

(57) ABSTRACT

Embodiments of the present invention generally relate to a leak proof drinking cup including a valve assembly and a removable lid with a drinking spout and a vent. The valve assembly includes a drinking valve, a venting valve, or both. When in use, the valve assembly engages with the lid to prevent leaks or spills and to permit the flow of air into the cup. When not in use, the valve assembly disengages from the lid and the valve is open to facilitate proper cleaning of the valve assembly.

19 Claims, 15 Drawing Sheets

LEAK PROOF CONTAINER

RELATED APPLICATIONS

This application claims priority to a provisional patent application, U.S. Ser. No. 61/253,254, filed Oct. 20, 2009. U.S. Ser. No. 61/253,254 is incorporated by reference here in its entirety.

FIELD OF THE INVENTION

The present technology relates to an improved leak proof container. More particularly, the present technology relates to a cup having a lid with a drinking spout and an air vent and a removable valve assembly incorporated in the lid such that it engages the drinking spout and air vent to control the flow of fluids from the cup and of air into the cup.

BACKGROUND OF THE INVENTION

A wide variety of cups specifically designed for use by infants and children are commercially available. In such cups, it is advantageous to have a feature that prevents spilling or leaking if the cup is accidentally knocked over or used in a moving vehicle where the liquid could be spilled by normal movement.

Currently there are cups commercially available that incorporate a valve feature in the lid of the cup to prevent spilling or leaking. The valve feature includes a drinking valve that permits the liquid to exit from the drinking cup and a vent valve to allow ambient air into the drinking cup. When the consumer using the cup drinks from the drinking spout, the drinking valve opens and allows liquid to come out. At the same instant, the vent valve responds to the suction on the drinking valve and opens to allow ambient air into the cup. Examples of such valves are shown in FIGS. 1 and 3.

The valve assembly of the currently available leak proof cups is designed to be "normally closed." This means that the drinking valve is closed unless a force is applied. Thus, if the drinking cup is knocked over, even if there is a small amount of hydrostatic pressure due to the liquid in the cup, no liquid will come out the drinking spout or vent. Without a small amount of vacuum or suction applied to the drinking valve, it is not possible for liquid to come out of the drinking cup.

Despite the benefits, there are a number of issues with the currently available leak proof cup valve designs. One problem with the current valve designs is that cleaning of the valve is difficult as the valve needs to be opened to flush out any remaining liquid, such as milk or fruit juices. Failure to properly clean and sterilize the valve assembly can result in spoilage and possible illness.

Another problem with the current valve designs is that the valve assembly can be dislodged if the cup is dropped. In this case, not only can liquid spill out, but, with the valve removed, an unexpected large volume of liquid can exit the drinking spout when the cup is used, which can lead to choking.

The lid and valve design described herein addresses the need to provide an easy-to-clean valve assembly for leak proof cups that attaches to the lid of the cup in such a way that it is not dislodged when dropped.

BRIEF SUMMARY OF THE INVENTION

One aspect of the invention is a leak proof container including a valve. When in use, the valve assembly engages with the wall of the container to prevent leaks or spills. When not engaged with the wall of the container, the valve assembly is normally open to facilitate proper cleaning of the valve assembly.

Another aspect of the invention is a leak proof drinking container including a container wall, a drinking aperture, a vent aperture, and one or both of a first valve and a second valve. The container wall defines an enclosure for containing a liquid. The drinking aperture is sized for passing a liquid from the enclosure. The vent aperture is sized for passing air in through the container wall as liquid is removed from the container.

The first valve (if present) is a drinking valve configured to engage the container wall, to be normally closed when engaging the container wall. The first valve opens when engaging the container wall to allow liquid out of the drinking aperture while suction is applied to the drinking aperture. The first valve is normally open when disengaged from the container wall.

The second valve (if present) is a vent valve configured to engage the container wall, to be normally closed when engaging the container wall. The second valve opens when engaging the container wall to allow air into the container while suction is applied to the container. The second valve is normally open when disengaged from the container wall.

DETAILED DESCRIPTION OF THE INVENTION

Figure 1:
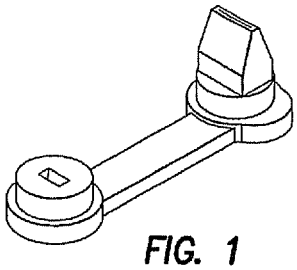
FIG. 1 (PRIOR ART)
FIG. 1 is a side elevation view of a prior art flow control valve.
Figure 2:
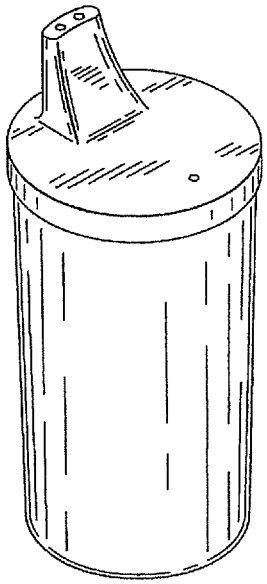
FIG. 2 (PRIOR ART)
FIG. 2 is a perspective view of a common leak proof cup.
Figure 3:
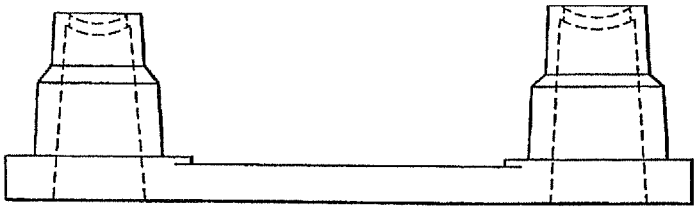
FIG. 3 (PRIOR ART)
FIG. 3 is a side elevation view of a prior art flow control valve shown in U.S. Pat. No. 6,422,415.
Figure 4:
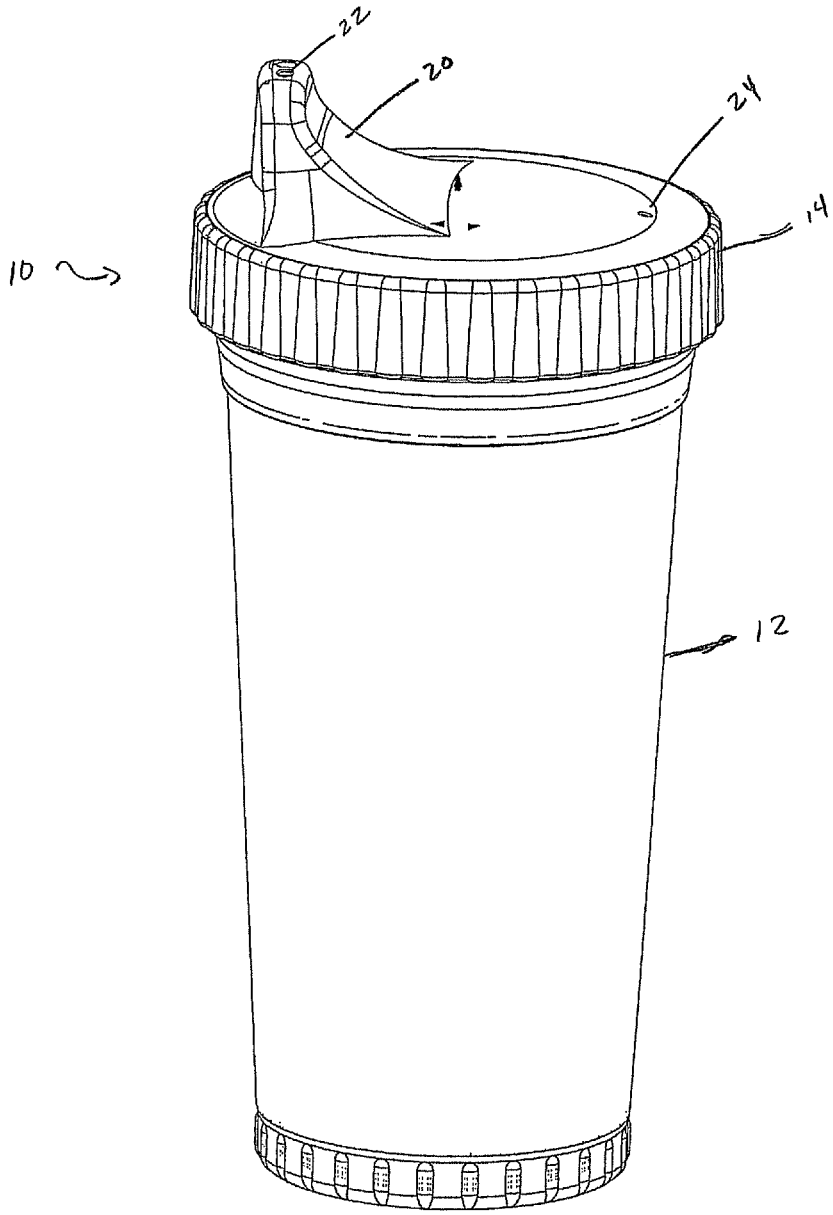
FIG. 4 is a perspective view of the leak proof cup of the present invention.
Figure 5:
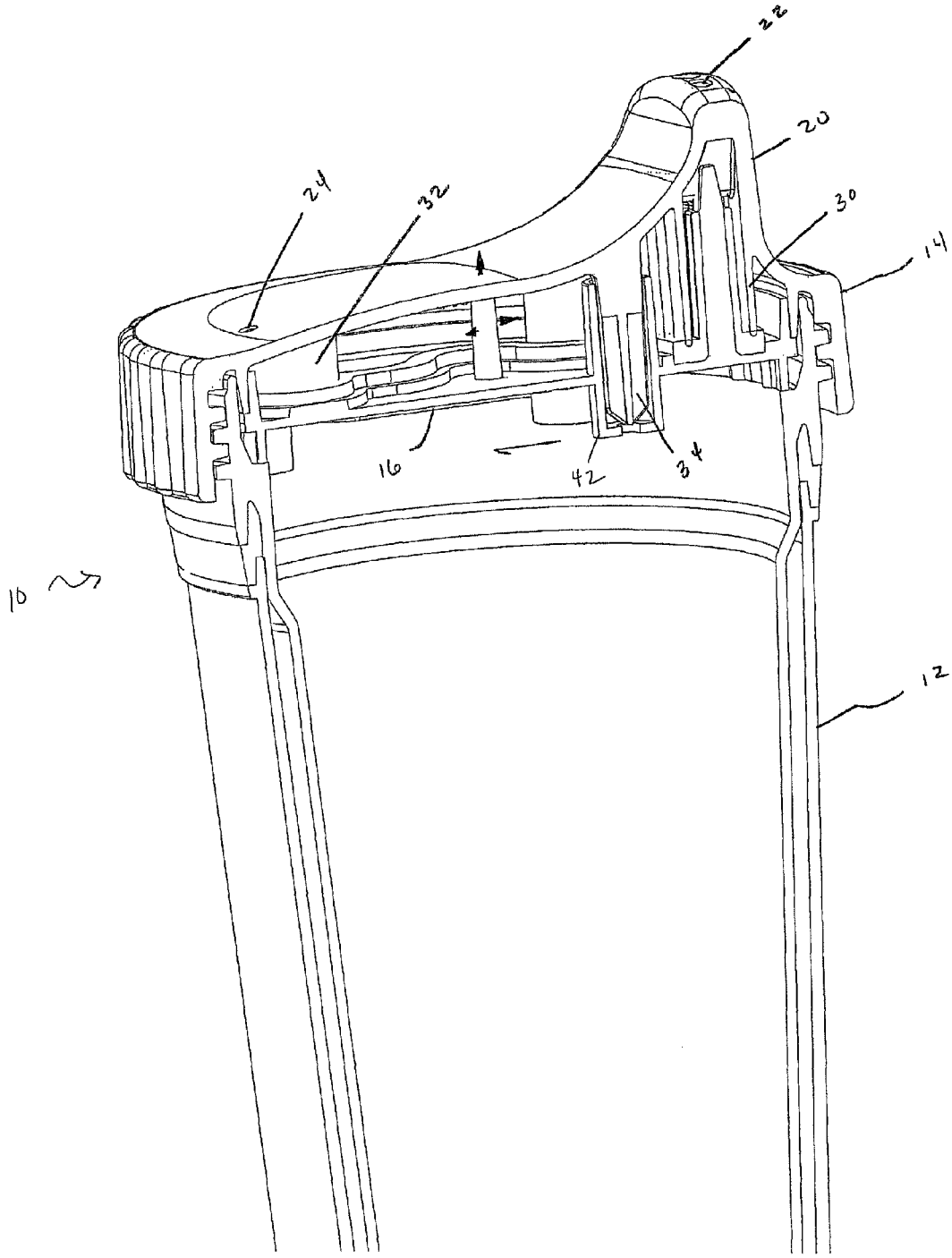
FIG. 5 is a cross-section view of the leak proof cup.
Figure 6:
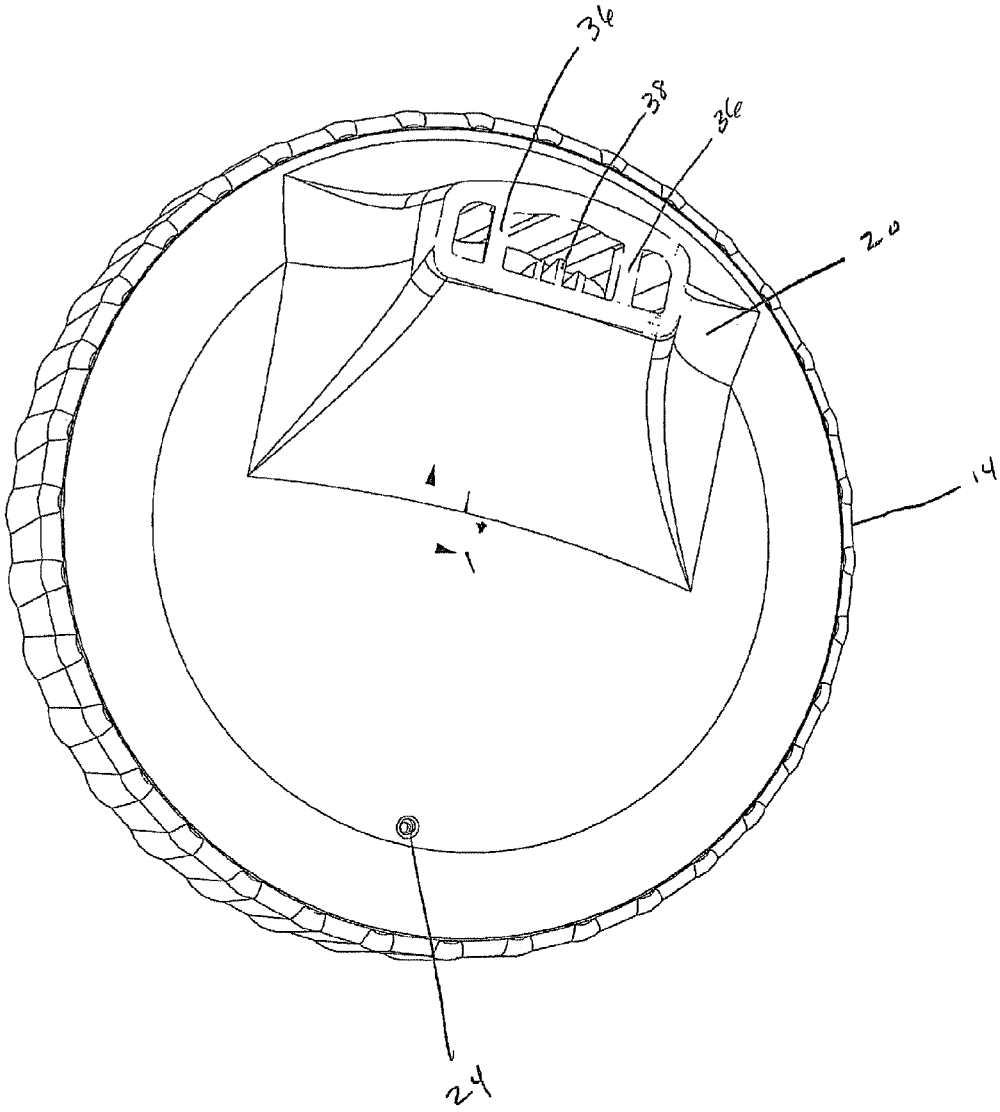
FIG. 6 is a top view of the lid with a cross-section view of the drinking spout.
Figure 7:
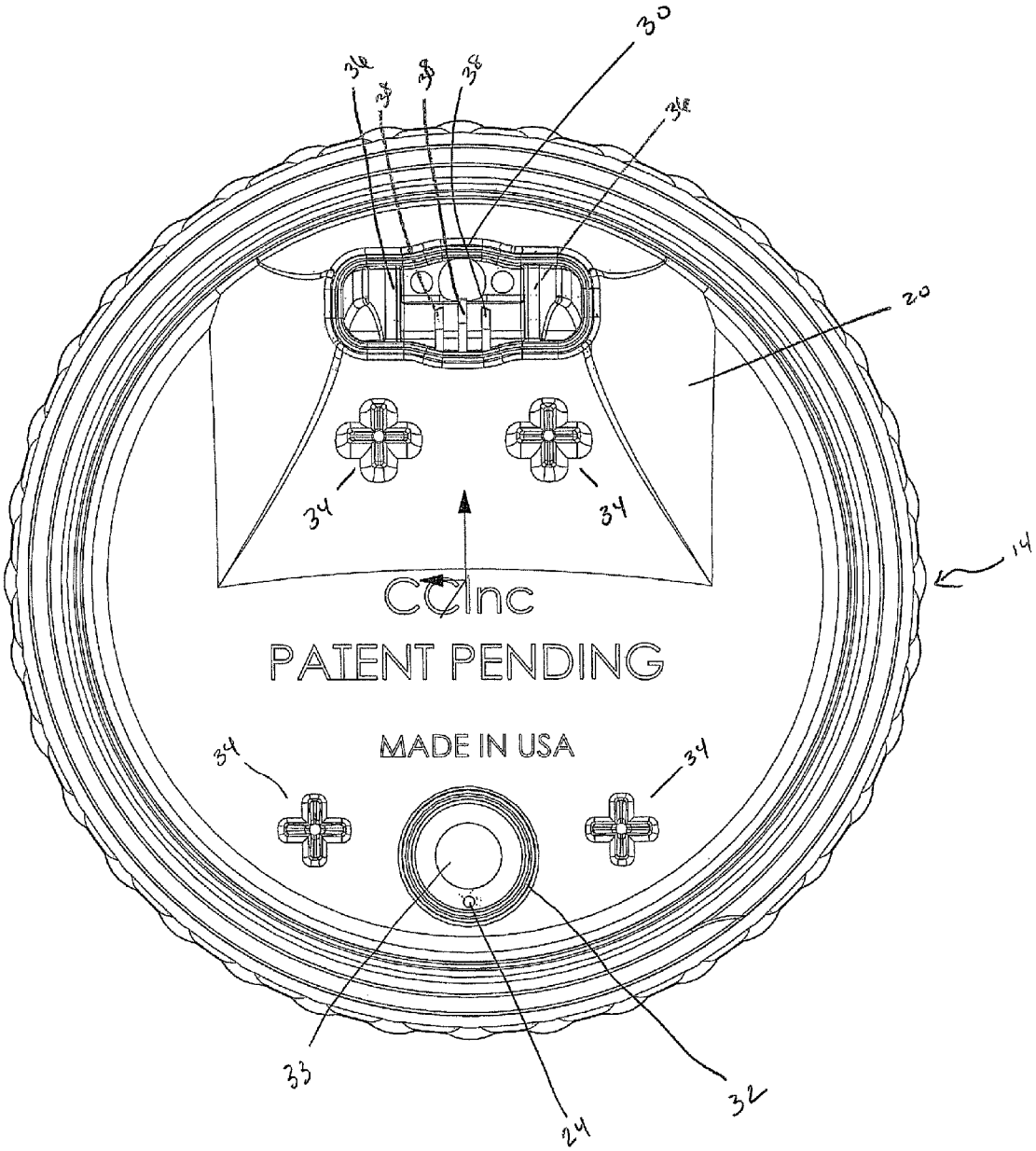
FIG. 7 is a bottom view of the lid.
Figure 8:
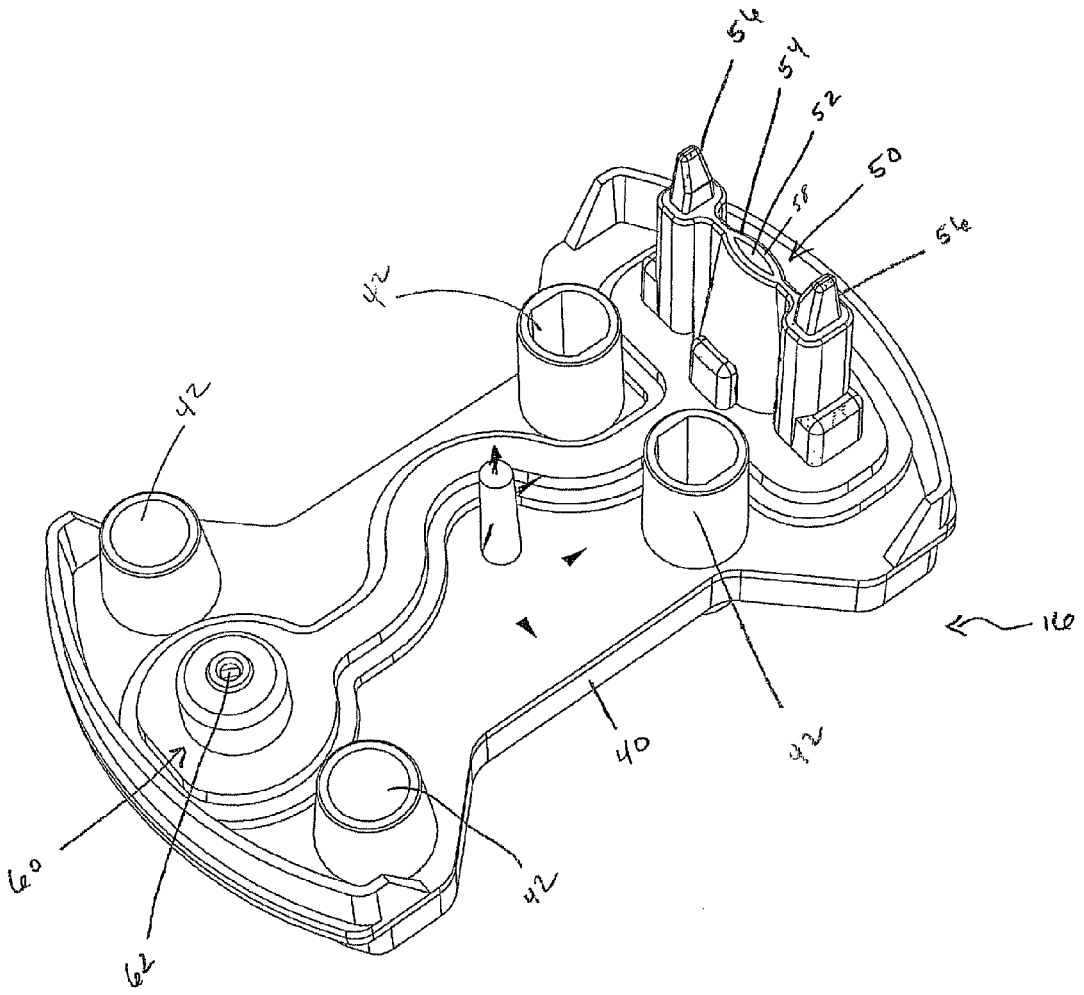
FIG. 8 is a perspective view of the valve assembly of the present invention.
Figure 9:
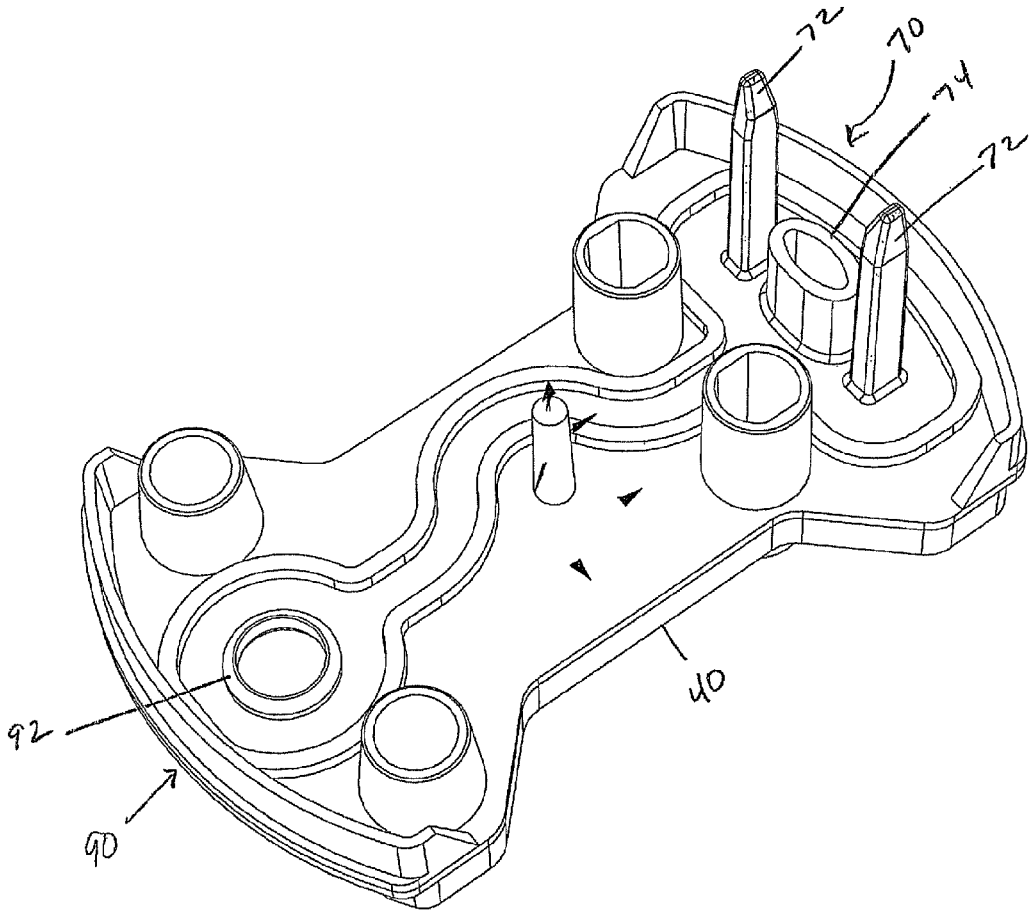
FIG. 9 is a perspective view of the rigid parts of the valve assembly of the present invention.
Figure 10:
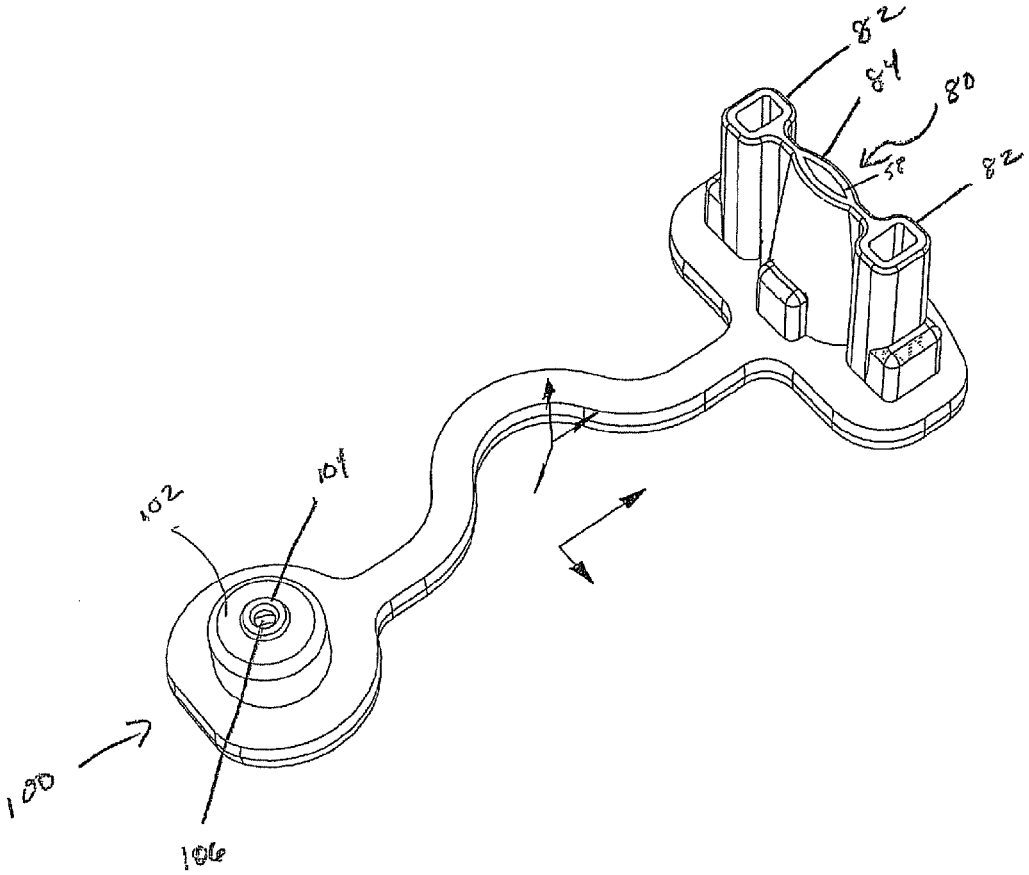
FIG. 10 is a perspective view of the flexible parts of the valve assembly of the present invention.
Figure 11:
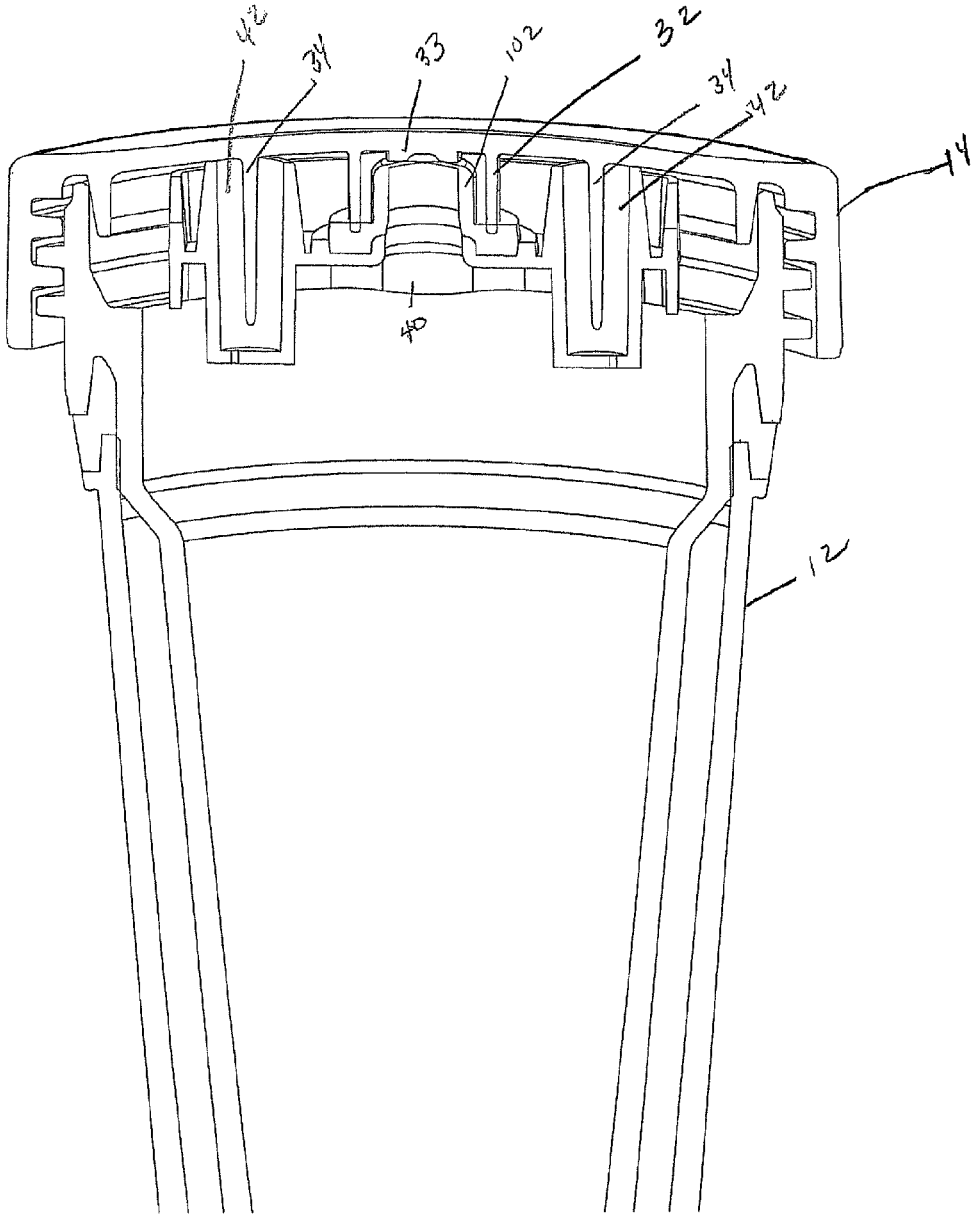
FIG. 11 is a cross-section view of the lid illustrating the second or venting valve.
Figure 12:
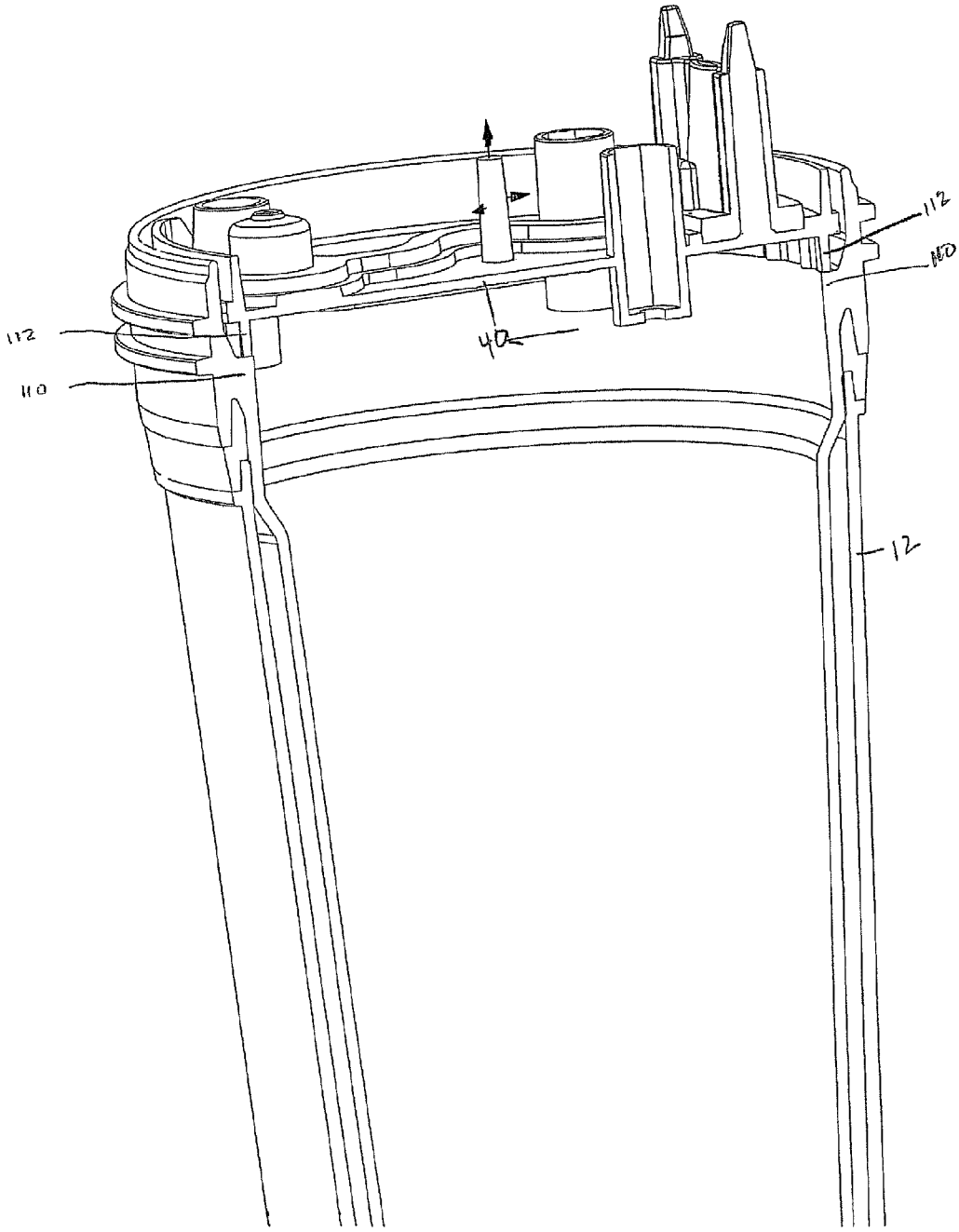
FIG. 12 is cross-section view of the drinking cup assembly.
Figure 13:
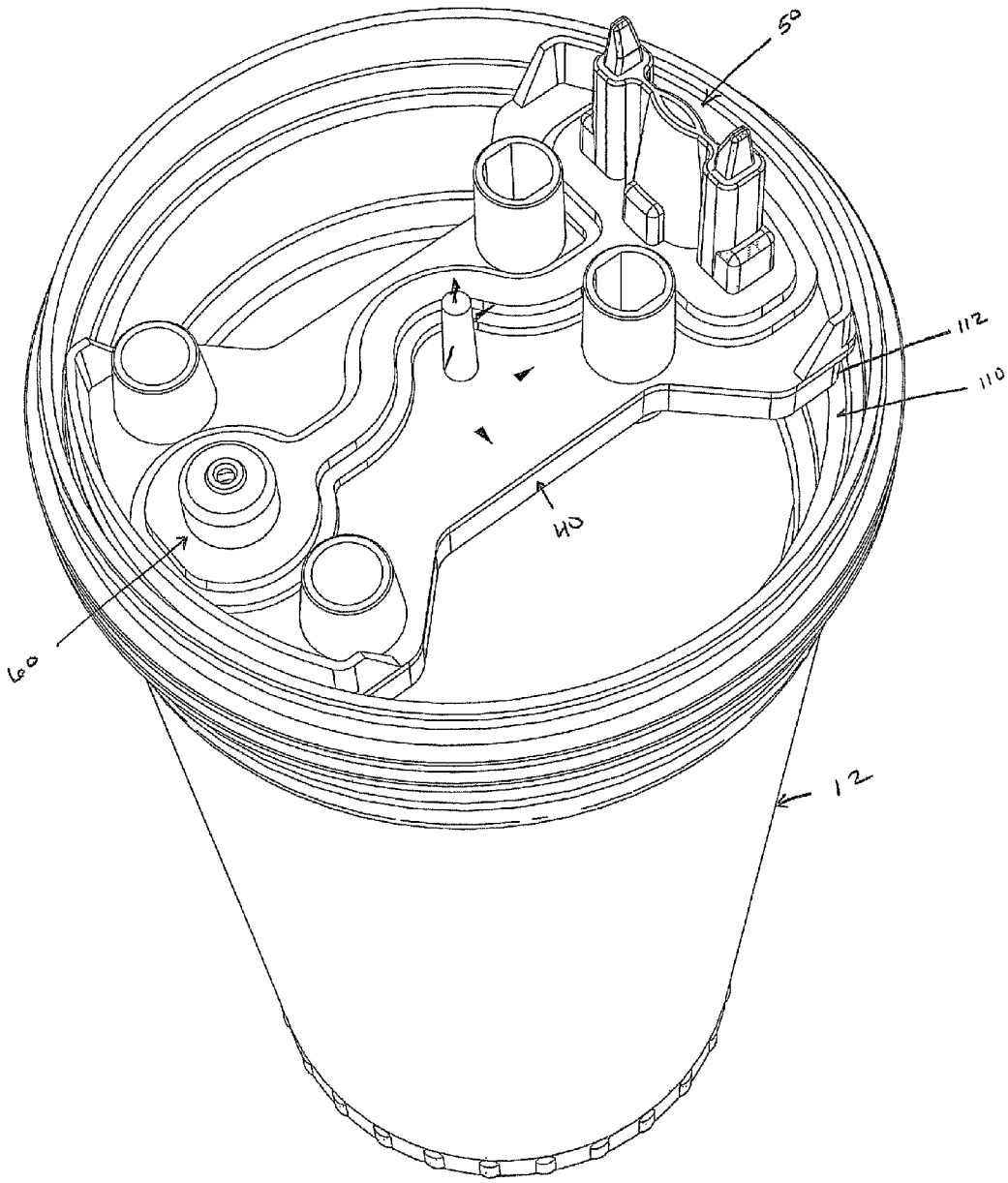
FIG. 13 is a top view of the valve assembly in the base container.
Figure 14:
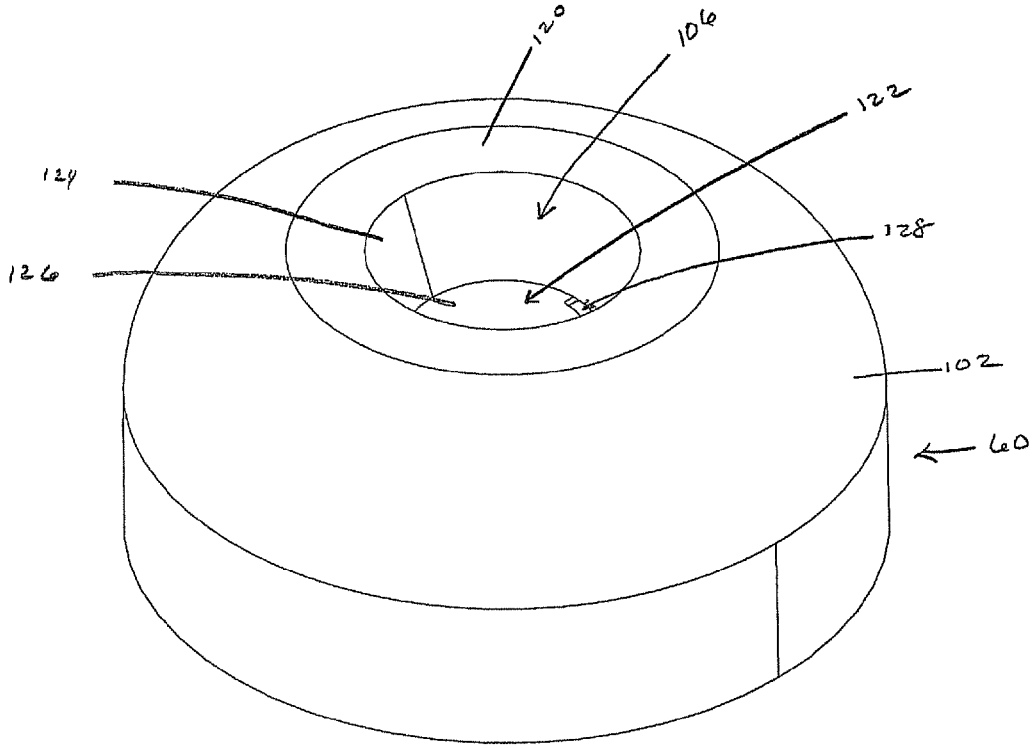
FIG. 14 is a perspective view of a third or hydrostatic valve.
Figure 15:
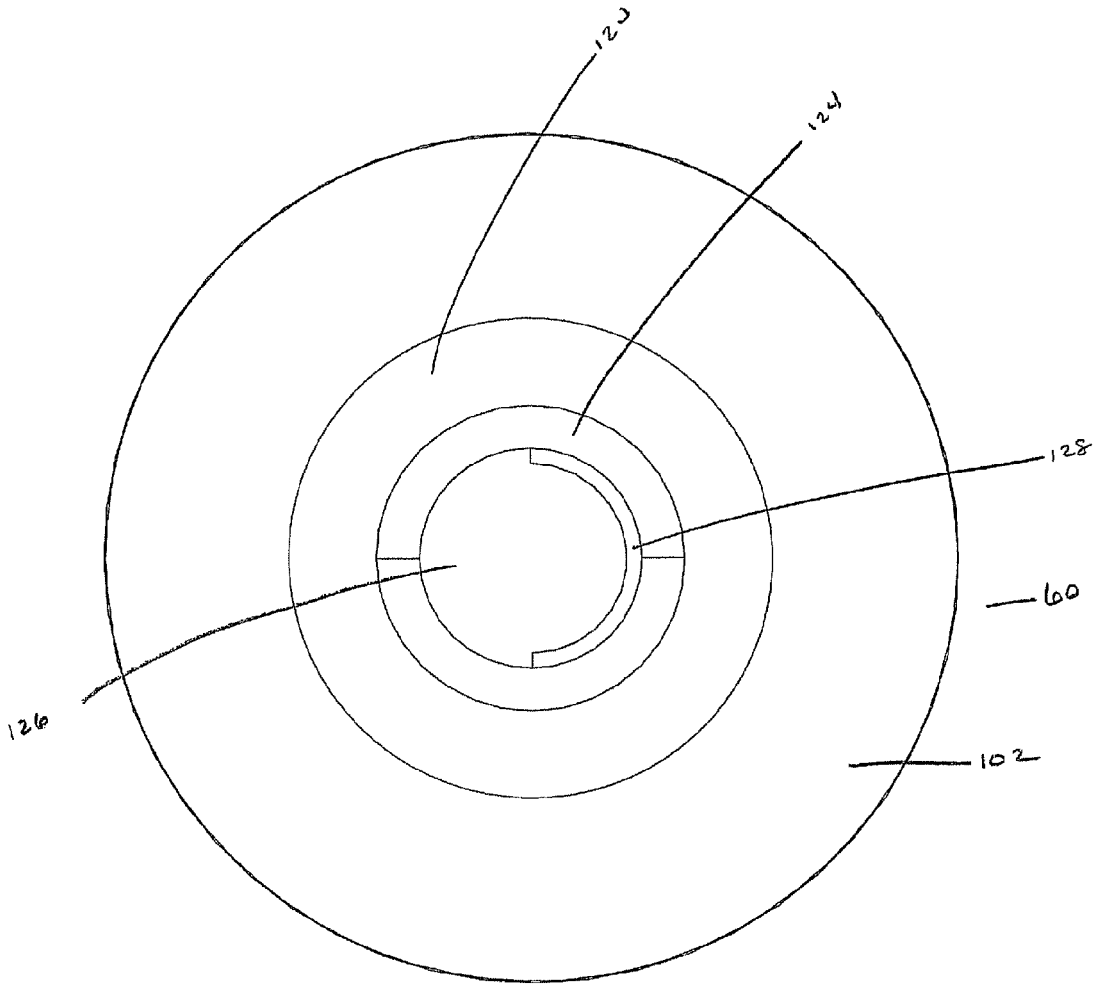
FIG. 15 is a top view of the third or hydrostatic valve.
Figure 16:
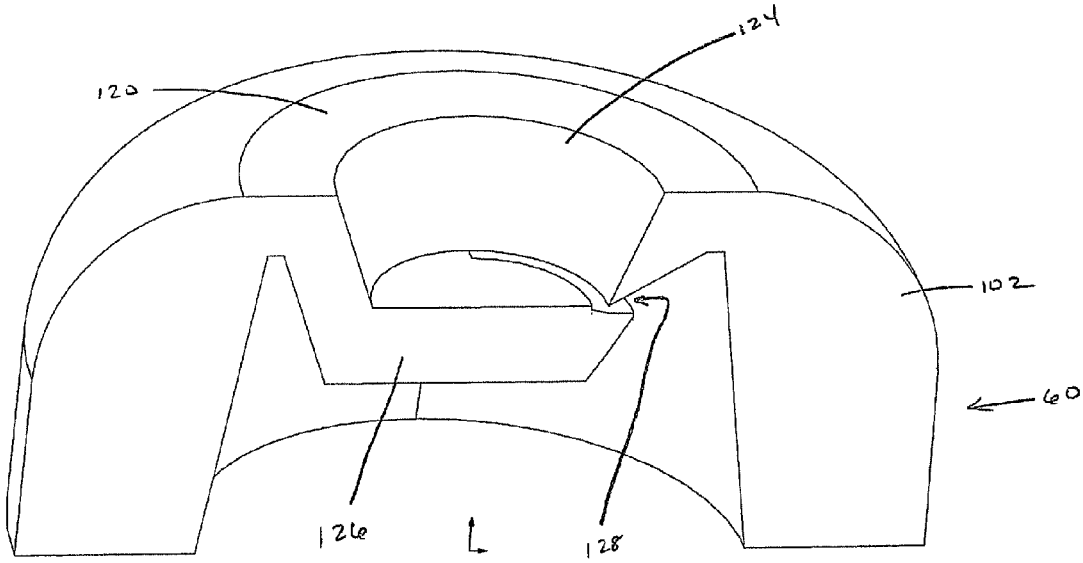
FIG. 16 is a cross section view of the third or hydrostatic valve.
Figure 17:
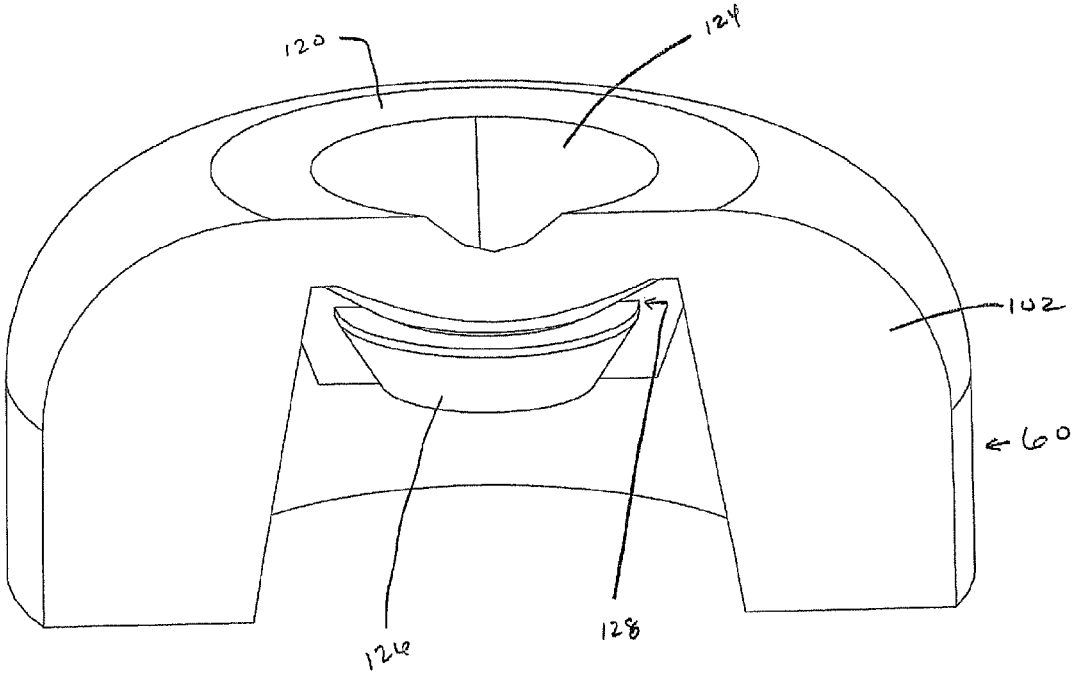
FIG. 17 is another cross section view of the third or hydrostatic valve.

One embodiment of the present invention relates to a leak proof drinking cup 10. The cup 10 is formed of three parts: a base container 12, a removable lid 14, and a valve assembly 16. In the alternative, the cup may be a single walled container formed of only two parts: the container and a valve assembly. An example of a two-part container is a bladder commonly used for beverages.

In the preferred embodiment, the removable lid 14 has a drinking spout 20 with one or more openings 22 and an air vent 24. The drinking spout 20 permits liquids to pass out from the interior of the base container 12. The air vent 24 permits ambient air to enter in to the base container 12 as liquid is removed. The air vent 24 may be an integral part of the drinking spout 20 or a stand-alone element located elsewhere on the cup 10. In an alternative embodiment, the cup 10 may simply have a drinking aperture rather than a drinking spout 20.

The lid 14 in the preferred embodiment has two sleeves formed on the underside thereof. The first sleeve 30 is generally oval in shape in the illustrated embodiment and is formed within the drinking spout 20. The second sleeve 32 is circular in shape in the illustrated embodiment and is formed below and in alignment with the air vent. The underside of the lid also has one or more posts 34, which aid in positioning and securing the valve assembly 16.

The valve assembly 16 comprises three general structures: the base 40, the first valve, also known as a drinking valve, 50, and the second valve, also known as a venting valve, 60. The valve assembly is formed to be engaged with the underside of the lid 14. In the preferred embodiment, the first valve, also known as a drinking valve, 50 is positioned within the first sleeve 30 and the second valve, also known as a venting valve, 60 is positioned within the second sleeve 32. In alternative embodiments, the drinking valve may be located adjacent to or in close proximity of a drinking aperture located anywhere on the container wall.

The valve assembly 16 is constructed from at least two materials that provide specific functions. The valve assembly can also be formed from multiple parts. In the preferred embodiment, the valve assembly is made as a single component using two materials, for example a two shot injection molded component.

The base 40 of the valve assembly 16 provides for the general structure of the valve assembly 16, alignment and engagement of the valve assembly 16 to the underside of the lid 14, and for support of the first valve, also known as the drinking vent valve 50 and second valve, also known as a venting valve, 60. Thus, the base 40 of the valve assembly 16 desirably is formed from a relatively rigid material. This relatively rigid base material may be selected from polypropylene, polyethylene, nylon, polyester, polystyrene, rigid PVC, styrene based resins, or a similar material.

There are two valves utilized on the valve assembly 16. The first valve, also known as a drinking valve, 50, is where the liquid normally exits the container 10. The second valve, also known as the second valve, also known as a venting valve, 60, allows air to enter the container 10, allowing the liquid to exit. The first and second valves provide the sealing function for the apertures of the container 10. Therefore, they are formed from a pliable material that is easily formed, flexible, and can create a sealing surface. This pliable material may be any relatively soft material such as silicone, flexible PVC, EVA (ethylene vinyl acetate), natural or synthetic rubber, a thermoplastic elastomer (TPE), or similar material.

The first valve, also known as a drinking valve, 50 and second valve, also known as a venting valve, 60 have orifices 52, 62 that are "normally open" when not engaged within the lid 14. These "normally open" orifices allow liquids to drain from the valves when the valves are not engaged in the lid 14. The open orifices 52, 62 also facilitate proper cleaning and sterilization of the valves.

In order to operate as intended in a spill proof container, the normally open first valve, also known as a drinking valve, 50 and second valve, also known as a venting valve, 60 are closed when assembled into the lid 14. In the preferred embodiment, two distinct valve designs are used for the first valve, also known as a drinking valve, 50 and the second valve, also known as a venting valve, 60.

The first valve, also known as a drinking valve, 50 comprises three parts: a center oval portion 54 and two extension posts 56. As described in more detail below, the center oval portion 54 of the first valve, also known as a drinking valve, 50 is in the shape of an extended oval extending from the base 40 of the valve assembly 16 with an opening at the top and bottom to facilitate fluid flow from the interior of the container 10 to the drinking spout 20. By making the first valve, also known as a drinking valve, 50 in this extended shape, the sidewalls are flexible and the valve 50 remains open when the valve assembly 16 is not engaged with the lid 14. When the valve assembly 16 is engaged with the lid 14, the extension posts 56 are drawn apart closing the center oval portion 52 of the first valve, also known as a drinking valve, 50 to prevent leaks and spills.

In the preferred embodiment, the first valve, also known as a drinking valve, 50 is constructed of two parts: a rigid base 70 and a flexible portion 80. The rigid base 70 is molded with and as part of the base 40 of the valve assembly 16. The flexible portion 80 of the first valve, also known as a drinking valve, 50 is then molded over and onto the rigid base 70 and the base 40 of the valve assembly 16. The flexible portion 80 extends upward from the base 40 to a height such that the top of the center oval portion 54 of the first valve, also known as a drinking valve, 50 is in fluid communication with the inside of the drinking spout 20.

The rigid base 70 comprises three parts: two extension posts 72 and a center oval cylinder 74. The extension posts 72 are positioned on opposite sides of the center oval cylinder 74. The extension posts 72 and the center oval cylinder 74 are molded at the same time as and as part of the base 40 of the valve assembly 16. The flexible portion 80 of the first valve, also known as a drinking valve, 50 is then molded over and to the extension posts 72 and a center oval cylinder 74.

While the flexible portion 80 of the first valve, also known as a drinking valve, 50 is molded as one unit, it comprises three structural parts: two extension post sleeves 82 and a center oval tube 84. The extension post sleeves 82 and the center oval tube 84 are molded over and onto the rigid base 70 to form the first valve, also known as a drinking valve, 50.

As a result of the molding process, the center oval portion 54 of the first valve, also known as a drinking valve, 50 is connected on opposite sides to the two extension posts 56. When the valve assembly 16 is not engaged with the lid 14, the flexible material connecting the center oval portion 54 to the two extension posts 56 is relaxed, allowing the end or lips 58 of the center oval portion 54 of the first valve, also known as a drinking valve, 50 to remain in the normal, open position.

When the valve assembly 16 is engaged with the lid 14, the two extension posts 56 engage abutments 36 located on the underside of the lid 14. In the preferred embodiment, the abutments 36 are located in the drinking spout 20. When the two extension posts 56 engage the abutments 36, one or both of the extension posts 56 are flexed away from the center oval portion 54, stretching the material between the two extension posts 56 and the center oval portion 54. The stretching of this material then stretches the center oval portion 54, bringing the lips 58 of the center oval portion 54 together. This loading of the center oval portion 54 brings the lips 58 in close proximity or touching to create a spill proof seal. While the spill proof seal may not be completely air and/or liquid tight, the seal will be sufficient to preventing an appreciable amount of liquid to flow out of the first valve, also known as a drinking valve, 50.

In the preferred embodiment, this seal is opened by the typical suction created when drinking by mouth through the drinking spout.

To further ensure that the lips 58 of the first valve, also known as a drinking valve, 50 seal, an abutment 38, such as closing ribs, may be located on the underside of the lid 14. In the preferred embodiment, the abutment 38 is located inside the drinking spout 20. When the valve assembly 16 is engaged with the lid 14, the abutment 38 presses against one side of the center oval portion 54 of the first valve, also known as a drinking valve, 50 forcing that side against the other to make the spill proof seal.

The thickness and durometer of the flexible material can be used to adjust the amount of bias or sealing force on the first valve, also known as a drinking valve, 50. The thickness and durometer of the rigid material used to construct the extension posts 56 can also be used to adjust the amount of bias or sealing force on the first valve, also known as a drinking valve, 50. Altering these materials will affect the amount of suction or cracking pressure required to open the first valve, also known as a drinking valve, 50.

In the preferred embodiment, the second valve, also known as a venting valve, 60 is constructed of two parts: a rigid base 90 and a flexible convex dome portion 100. The rigid base 90 is molded with and as part of the base 40 of the valve assembly 16. The flexible dome portion 100 of the second valve, also known as a venting valve, 60 is then molded over and to the rigid base 90 and the base 40 of the valve assembly 16. The flexible dome portion 100 extends upward from the base 40 to a height such that the top of the flexible dome portion 100 is in contact with the inside of the lid 14.

The rigid base 90 of the second valve, also known as a venting valve, 60 is comprised of a rigid ring 92. The rigid ring 92 is molded at the same time as and as part of the base 40 of the valve assembly 16. The flexible dome portion 100 of the second valve, also known as a venting valve, 60 is then molded over the rigid ring 92 to form the second valve, also known as a venting valve, 60. Ideally, the material of the flexible dome portion 100 will be the same material used to form the flexible portions of the first valve, also known as a drinking valve, 50, but may be another flexible material.

The flexible dome portion 100 of the second valve, also known as a venting valve, 60 comprises a flexible dome 102 with a center aperture 106 and a featured or sealing bead 104 on top of the flexible dome 102 and ringing the center aperture 106.

When the second valve, also known as a venting valve, 60 is not engaged with the lid 14, the center aperture 106 remains in the normal open position. When the second valve, also known as a venting valve, 60 is engaged into the lid 14, the sealing bead 104 of the second valve, also known as a venting valve, 60 contacts the flat surface on the underside of the lid 14 within the second sleeve 32, creating a spill proof seal. While the spill proof seal may not be completely air and/or liquid tight, the seal will be sufficient to preventing an appreciable amount of liquid to flow out of the second valve, also known as a venting valve, 60. When suction is applied to the drinking spout 20, the first valve, also known as a drinking valve, 50 opens, which communicates the suction to the container 10, which pulls the dome shaped second valve, also known as a venting valve, 60 away from the lid 14, creating an opening to the ambient pressure, allowing air into the container 10, and allowing liquid to flow out of the drinking spout 50.

In an alternative embodiment, an abutment 33 is located on the underside of the lid 14 within sleeve 32. When the second valve, also known as a venting valve, 60 engages the lid 14, the sealing bead 104 is in contact with the abutment 33 to create the spill proof seal of the center aperture 106.

In an alternative embodiment, the flexible dome portion 100 of a third valve, also known as a hydrostatic valve, 122 comprises a flexible dome 102 with a flat top face 120 and a center aperture 106. The third valve, also known as a hydrostatic valve, 122 comprises an inverted cone 124 within the center aperture 106 of the flexible dome 102, a vent plate 126 at the base of the cone 124, and a vent grove 128. The vent groove 128 extends between the bottom of the inverted cone 124 and the top of the vent plate 126 for approximately 180 degrees.

In the alternative embodiment, the third valve, also known as a hydrostatic valve, 122 always remains in the normal open position until closed by hydrostatic pressure. When the third valve, also known as a hydrostatic valve, 122 is engaged with the lid 14, the flat top face 120 of the third valve, also known as a hydrostatic valve, 122 contacts the flat surface on the underside of the lid 14 or on the abutment 33 within the second sleeve 32, creating a seal. When hydrostatic pressure is applied to the vent plate 126 from within the container 10, the vent plate 126 is pressed up and against the base of the inverted cone 124 sealing the vent groove 128. While the vent seal may not be completely air and/or liquid tight, the seal will be sufficient to preventing an appreciable amount of liquid to flow out of the second valve, also known as a venting valve, 60. As in the preferred embodiment, this alternative vent valve may also comprise a featured or sealing bead on the flat top face 120 of the flexible dome 102 and ringing the center aperture 106.

The size of the dome and the thickness and durometer of the flexible material can be used to adjust the amount of bias or sealing force of the second valve, also known as a venting valve, 60, which will affect the amount of suction or cracking pressure of the valve system.

Although the designs of the first valve, also known as a drinking valve, 50 and second valve, also known as a venting valve, 60 are different from those of the preferred embodiment, one skilled in the art will recognize that it is possible that the drinking valve design could function as a vent valve if oriented in the opposite direction.

The valve assembly 16 may also include one or more sleeves 42. These sleeves 42 are molded with the rigid base 40 of the valve assembly 16 and are located on the base 40 such that each sleeve 42 will engage with the corresponding post 34 located on underside of the lid 14. The sleeve(s) 42 and post(s) 34 assist in positioning the valve assembly 16 under the lid 14, in engaging the valve assembly 16 to the lid 14, and in securing the valve assembly 16 to the lid 14.

In the preferred embodiment, the valve assembly 16 is shown as one component. However, the two valves have different functions and different designs. Therefore, it is not necessary that they are one piece, they could be two separate components.

In the preferred embodiment, the valve assembly 16 is shown as being constructed of two materials in a two shot injection molded system. One skilled in the art will recognize that the valve assembly can be constructed from a number of individual parts, each individual part formed of the same or different materials.

In an additional embodiment of the invention the valve assembly 16 can be designed so that the valve assembly 16 is restrained between the base container 12 and the lid 14 so that it cannot be dislodged accidentally. In one such embodiment, a ridge 110 is molded into the base container 12 of the drinking cup 10 and a seat 112 is molded on the valve assembly 16. The valve assembly 16 is placed in the base container 12 such that the seat 112 engages the base container ridge 110. The lid 14 is then placed over the valve assembly 16 such that the first valve, also known as a drinking valve, 50 is aligned with the drinking spout 20 and the second valve, also known as a venting valve, 60 is aligned with the air vent 24. The lid 14 is then secured to base container 12, securing the valve assembly 16 between them and preventing the valve to be dislodged.

In the preferred embodiment, the base container 12 and the lid 14 mechanically seal to prevent liquid from leaking from the joint between the base 12 and the lid 14. In an alternative embodiment of the invention, the valve assembly 16 is designed to seal the joint between the base container 12 and the lid 14. In such an embodiment, the base 40 of the valve assembly 16 is a full disk with an outer circumference just smaller than the interior circumference of the base container 12. The underside of the valve assembly incorporates a seat 112 molded around the entire circumference of the valve assembly 16. The base container 12 is molded with a ridge 110 around the entire internal circumference of the container 12 that corresponds to the seat 112 on the valve assembly 16. The valve assembly 16 is placed in the base container 12 such that the seat 112 engages the ridge 110 in the base container 12. The lid 14 is then placed over the valve assembly 16 such that the first valve, also known as a drinking valve, 50 is aligned with the drinking spout 20 and the second valve, also known as a venting valve, 60 is aligned with the air vent 24. The lid 14 is then tightened to base container 12, securing the valve assembly 16 between the lid 14 and base container 12, and pressing the seat 112 of the valve assembly 16 against the ridge 110 of the base container 12 to create a mechanical seal and prevent any leaking from the joint between the base 12 and the lid 14.

In another embodiment of the sealing mechanism described above, a flexible material may be incorporated in the valve assembly 16 at the seat 112 to create or enhance the sealing ability of the valve assembly 16. Such flexible material may be any of the flexible materials identified above for the drinking and vent valves. When the lid 14 is tightened to base container 12, securing the valve assembly 16 between them, the flexible material located at the seat 112 of the valve assembly 16 is pressed between the seat 112 and the ridge 110 of the base container 12 to create a mechanical seal or to enhance the mechanical seal of the seat 112 and ridge 110 to prevent any leaking from the joint between the base 12 and the lid 14.

In the following, further exemplary embodiments of the invention are disclosed:

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practising the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

What is claimed is:

1. A leak proof drinking container comprising: a container wall defining an enclosure for containing a liquid; a drinking aperture sized for passing the liquid from the enclosure; a vent aperture sized for passing air in through the container wall as the liquid is removed from the container; and a first valve, where:

the first valve is a drinking valve configured to engage the container wall, the drinking valve having an orifice that is defined by a pair of opposing lips, the pair of opposing lips being configured to: (1) be held together when the drinking valve is engaging the container wall to close the orifice, (2) open the drinking valve when engaging the container wall to allow the liquid out of the orifice while suction is applied to the drinking aperture, and (3) be separated from each other to open the orifice when the drinking valve is disengaged from the container.

2. The leak proof drinking container of claim 1, further including a second valve that is vent valve that is configured to: (1) be normally closed when engaging the container wall, (2) open when engaging the container wall to allow air into of the container while suction is applied to the container, and (3) be normally open when disengaged from the container wall.

3. The leak proof drinking container of claim 1 where the container wall comprises at least a first abutment, that biases at least one of the pair of opposing lips toward the other to close the orifice of the drinking valve when the drinking valve engages the first abutment.

4. The leak proof drinking container of claim 1 where the container wall further comprises at least first and second abutments spaced apart, at least a portion of the drinking valve is located generally between the first and second abutments, and the first and second abutments engaging at least one of the lips of pair of opposing lips to bias the at least one lip toward the other to normally close the orifice of the drinking valve when the drinking valve engages the container wall.

5. The leak proof drinking container of claim 1 where the drinking valve further comprises at least first and second abutments spaced apart, at least a portion of the pair of opposing lips being located generally between the first and second abutments, and the first and second abutments engaging at least one of the pair of opposing lips to bias the at least one lip toward the other to close the orifice of the drinking valve when the drinking valve engages the container wall.

6. The leak proof drinking container of claim 1 where the drinking valve is a duck bill valve.

7. The leak proof drinking container of claim 1 where the container wall further comprises a drinking spout and the drinking aperture is located generally on the drinking spout.

8. The leak proof drinking container of claim 2, where the container wall comprises at least a first abutment, the vent valve having a normally open aperture configured to allow air to enter into the enclosure through the normally open aperture when the vent valve is open, and wherein the first abutment engages the vent valve to normally close the aperture when the vent valve engages the first abutment.

9. The leak proof drinking container of claim 2 where the container wall further comprises a vent valve sleeve, and the vent valve engages the container wall within the vent valve sleeve.

10. The leak proof drinking container of claim 2 where the vent valve further comprises a bead around a valve aperture.

11. The leak proof drinking container of claim 2, further comprising a third valve which is configured to (1) engage the container wall, to be normally open when engaging the container wall, (2) to open when engaging the container wall to allow air into of the container while suction is applied to the container, and (3) to be normally open when disengaged from the container.

12. The leak proof drinking container of claim 11 where the third valve further comprises a vent plate and a vent groove.

13. The leak proof drinking container of claim 11 where the third valve is a hydrostatic valve that closes in response to hydrostatic pressure from within the container.

14. The leak proof drinking container of claim 11 where the third valve further comprises a bead around a valve aperture.

15. The leak proof drinking container of claim 2 where the container wall comprises a first container wall defining a removable lid, a second container wall defining a vessel, the first and second container walls being removably engaged to define a joint.

16. The leak proof drinking container of claim 15 where the container wall further comprises a ridge; the first valve further comprises a seat; and the seat engages the ridge, defining a joint, to mechanically seal the enclosure and prevent liquid from passing from the enclosure at the joint between the first and second container walls.

17. The leak proof drinking container of claim 16 where the container wall further comprises a ridge; the second valve further comprises a seat; and the seat engages the ridge to mechanically seal the enclosure and prevent liquid from passing from the enclosure at the joint between first and second container walls.

18. The leak proof drinking container of claim 16, where one or both of the first valve and the second valve are part of a valve assembly, and where the seat engages the ridge to prevent the valve assembly from disengaging from the container wall.

19. The leak proof drinking container of claim 2, where one or both of the first valve and the second valve are part of a valve assembly, and where the container wall further comprises at least one post; at least one of the first and second valves further comprises at least one sleeve corresponding to the post; and the post engages the sleeve to position the valve assembly.

* * * * *